United States Patent [19]

Bergquist et al.

[11] Patent Number: 5,023,587

[45] Date of Patent: Jun. 11, 1991

[54] ARM FOR ELECTRIC SWITCHES AND THE LIKE CONTROLLED BY ELECTRICITY

[75] Inventors: Per-Marcus Bergquist, Lidingö; Henrik E. Troberg, Tumba, both of Sweden

[73] Assignee: Electrolux Research & Innovation Aktiebolag, Stockholm, Sweden

[21] Appl. No.: 534,137

[22] Filed: Jun. 6, 1990

[30] Foreign Application Priority Data

Jun. 12, 1989 [SE] Sweden ..... 8902103

[51] Int. Cl.[5] ..... H01H 61/00; H01H 71/18

[52] U.S. Cl. ..... 337/123; 337/132

[58] Field of Search ..... 337/123, 131, 132, 135, 337/397, 370, 371, 136, 137, 389

[56] References Cited

U.S. PATENT DOCUMENTS

| | | | |
|---|---|---|---|
| 2,789,180 | 4/1957 | Cox | 337/131 |
| 3,123,695 | 3/1964 | Strubberg | 337/123 |
| 3,968,469 | 7/1976 | Budlane | 337/389 |

FOREIGN PATENT DOCUMENTS

| | | | |
|---|---|---|---|
| 1396 | of 1892 | United Kingdom | 337/123 |

*Primary Examiner*—Harold Broome

*Attorney, Agent, or Firm*—Pearne, Gordon, McCoy & Granger

[57] ABSTRACT

An arm preferably for electric switches, the arm being controlled by electricity, and having a first fixed end the other end of which is movable perpendicular to the length direction of the arm. The arm comprises two parallel portions (47) separated by an air gap (17) or some other heat insulating material, and which are secured to each other at each end. At least one of the portions, being heated by electricity and, through longitudinal differential expansion with respect to the other portion, achieves said movement. The portions are so shaped that, adjacent the fixed end (at 45) with respect to the rest of the portions, they have a reduced bending resistance about an axis which is perpendicular to the length direction of the arm and with respect to said direction of movement.

6 Claims, 2 Drawing Sheets

ARM FOR ELECTRIC SWITCHES AND THE LIKE CONTROLLED BY ELECTRICITY

BACKGROUND OF THE INVENTION

This invention relates to an arm particularly suited for the operation of relays. The arm is controlled by electricity and has a first fixed end and a second end which is movable mainly perpendicular to the length direction of the arm. The arm comprises two mainly parallel elongated portions separated by an air gap or some other heat insulating material, so that at least one of the portions may be heated by electricity in order to effect said movement by longitudinal heat expansion with respect to the other portion.

PRIOR ART

Devices of the above-mentioned type are known, and are used for controlling electric switches. U.S. Pat. No. 3,716,814 describes such a device, wherein two leaf-shaped, elongated elements are placed at a distance from each other, one of the elements being heated by means of an electric circuit applied on it. The longitudinal expansion of the element which occurs is transferred to a turning motion of a contact holder which is parallel to the arm, this motion being used for breaking or closing a contact means. The device shown, however, is complicated and comprises several details cooperating with each other, which means that assembly of the device is difficult. There is also great risk that malfunctions will occur in the device because of its complexity. Moreover, the device must be adjusted with adjusting screws which are placed on the contact means. The large number of details also means that the device will have large dimensions, which is a drawback where limited space is a factor. Moreover, the contact holder operates with a creeping motion, i.e., the motion is comparatively slow, which means that arcs may be created which will affect the contact surface.

SUMMARY OF THE INVENTION

The purpose of the invention is to achieve a device of small dimensions and principally having the same function as the device described above, and which may be used to replace conventional relays in such apparatus where rapidity when transferring signals is of minor importance. Such apparatus, for instance, may be household appliances of different kinds, such as ranges, washing machines, dishwashers, etc. The device according to the invention is simple, and hence more economical to manufacture than previously known devices. It is also designed so that even small expansions, i.e., expansions such as are achieved by means of small effect circuits, are converted to comparatively large motions to be used for operating snap action type mechanisms and to control a contact means. This is achieved by means of a device having the characteristics set forth in the claims hereof.

Several embodiments of the present invention are illustrated. In each embodiment, the arm is cantilever-mounted. The arm includes a pair of elongated metallic arm portions which extend substantially parallel to each other and are thermally separated from each other. The arms are connected at their ends and provide one end mounted in a holder or housing. Adjacent to the one end or mounted end of the arm, the arm portions are provided with a section of reduced resistance to bending, while the portion extending therefrom is resistant to bending. Heating means are attached to each of the arm portions and are selectively energized to cause differential expansion therebetween and consequential pivotlike movement around the section of reduced resistance to bending. Such structure provides substantial movement of the free end of the arm in response to small amounts of differential expansion of the arm portions. This movement of the arm operates through a bistable spring system to cause snap action of an associated switch.

DETAILED DESCRIPTION OF THE DRAWINGS

Figure 1:
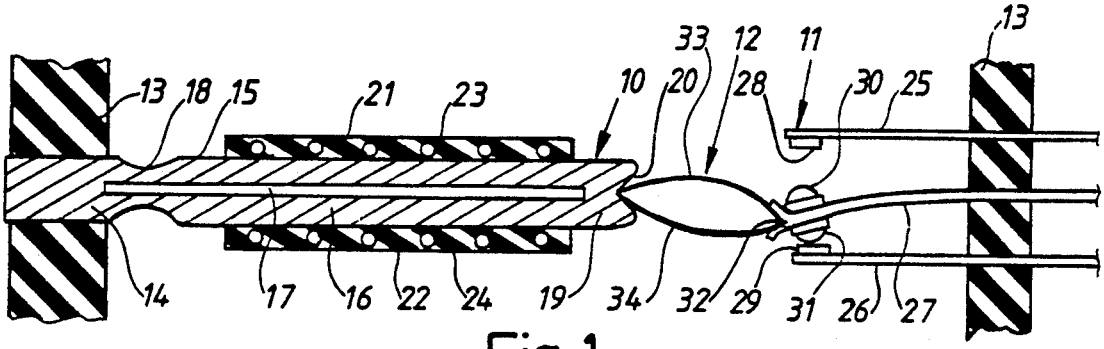
FIGS. 1 and 2 schematically illustrate a first embodiment of this invention and illustrate the manner in which the embodiment functions to cause snap action of the associated switch.
Figure 2:
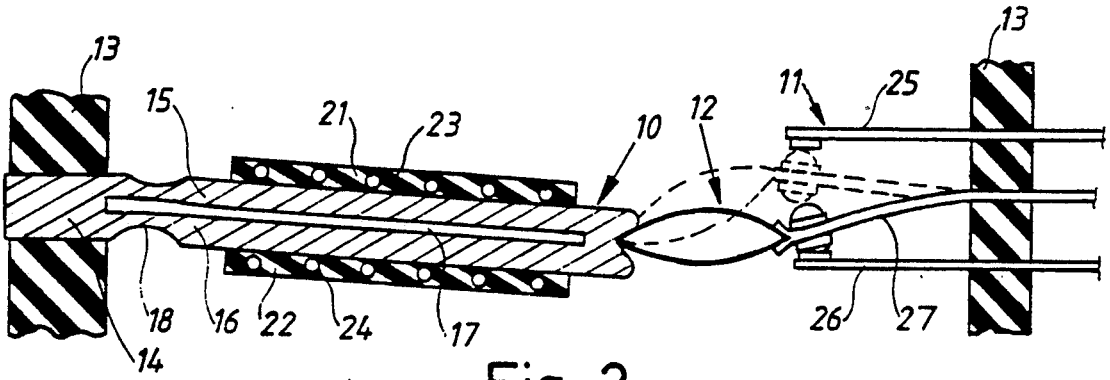

In the first embodiment illustrated in FIGS. 1 and 2, the device comprises an arm 10 which cooperates with a contact means 11 and a spring 12 clamped between the arm 10 and the contact means 11. The arm 10 and the contact means 11 are mounted in a holder 13.

The arm 10 includes a support portion 14 which is mounted in the holder 13. The support portion 14 joins two elongated portions 15, 16, which are separated by a longitudinal air gap 17. The elongated portions provide a reduced section 18 adjacent to the mounting portion 14. Since the portions 15, 16 have this reduced section, they will, at this reduced section, have less bending resistance about an axis perpendicular to the plane of the paper compared to the other sections of the portions. The outer ends of the portions 15 and 16 are joined to each other by an end portion 19 having an end recess 20 in which the spring 12 rests. The portions 15 and 16 each support a heating source which is a strip-shaped material 21, 22. The strip-shaped material may, for example, be a film enclosing an electric circuit 23, 24 through which current can be directed. The strip-shaped material 21, 22 is fastened to the portions 15 and 16 by gluing, or in any other suitable way. The strip-shaped material can be replaced by a printed circuit or the like which is produced in a conventional manner. The two portions 15 and 16 are of the same material, which preferably is metal.

The contact means 11 include an upper contact support 25, a lower contact support 26, and an intermediate, flexible contact support 27. These contact supports are metal, and are mounted in the holder 13. The contact supports project outwardly from the holder 13 in order to form terminals for electrical connections. The contact supports 25 and 26, respectively, are provided with fixed contacts 28 and 29 at their inner ends. Contacts 30 and 31 are mounted on opposite sides of the flexible contact support 27 and respectively engage the contacts 28 and 29 when the flexible support 27 snaps back and forth. The inner edge of the flexible contact support 27 has a recess 32 supporting the adjacent end of the spring 12.

The spring 12 comprises two arched, thin metal plates 33, 34 which are connected to each other so that the concave sides are facing each other. The ends of the plates are joined to each other at their ends where they extend into recesses 20 and 32.

In the position shown in FIG. 1, the arm 10 projects horizontally from the holder 13, and the spring 12 presses the metal arm 27 downwards so that the contact 31 engages the contact 29 of the arm 26. This allows current to flow between the arms 26 and 27 to the associated circuit.

In order to change the position of the switch, a control current is connected to the circuit 23 which heats the portion 15. This causes the portion 15 to be expanded longitudinally, while the unheated portion 16 maintains its length. A part of the heat is carried through the sections 18 and the portion 19 to the portion 16. However, the amount of heat transferred is small compared to the heat supplied through the circuit 23. The expansion difference between the portions 15 and 16 causes the free outer end of the arm 10 to move downwardly to the position shown in FIG. 2. This movement is a substantially pivotal movement, since almost all bending occurs in the thinned section 18. The portions 15 and 16 are thicker and tend to remain straight. Since this shape is maintained during the movement, no separating bending tension is created between the material 21 enclosing the circuit 23 and the portions 15, 16.

When the arm 10 moves to the position shown in FIG. 2 in full-line, the spring 12 passes through a position of instability, so that an upwardly directed force component is created on the metal support 27. This causes the support 27 to snap upwards to the position shown in dashed lines. This means that the electrical connection between the contact supports 26 and 27 is disconnected and, instead, an electrical connection is established between the supports 25 and 27 and the electrical conductors connected thereto.

If the current through the circuit 23 is cut off, the contact support 27 will remain in the dashed-line position, although the arm 10 returns to the position shown in FIG. 1. In order to return the contact support 27 to its original position, a current is connected through the circuit 24, which means that the arm 10 is bent upwardly, and thus snaps over the metal flexible support 27 to the original position. With this structure, a bistable switch is provided in which the flexible support moves back and forth with snap action.

Figure 3:
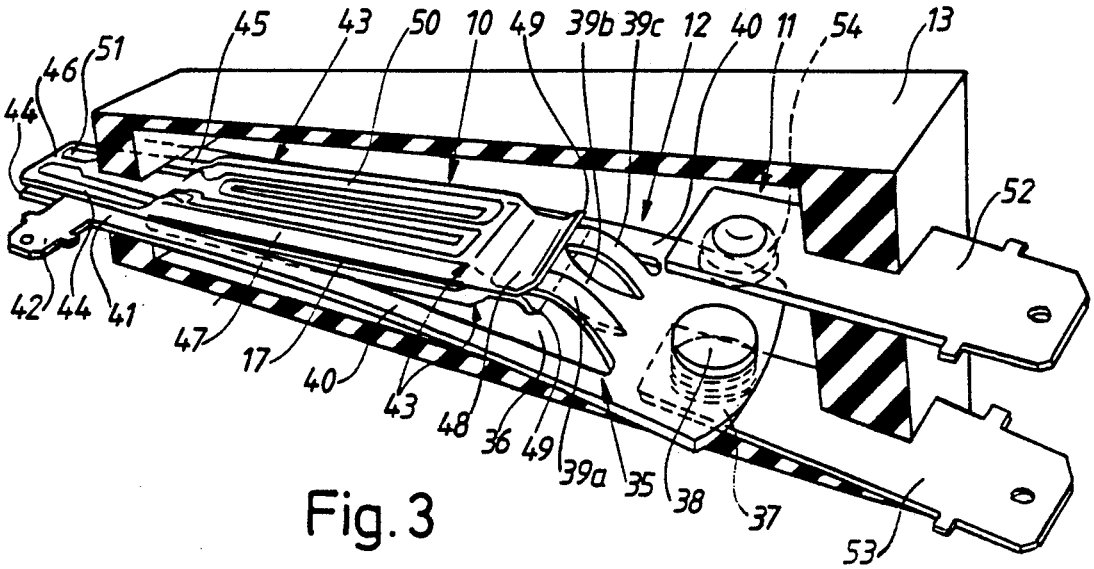
FIG. 3 is a perspective view, partially in longitudinal section, illustrating a second embodiment of this invention.
Figure 4:
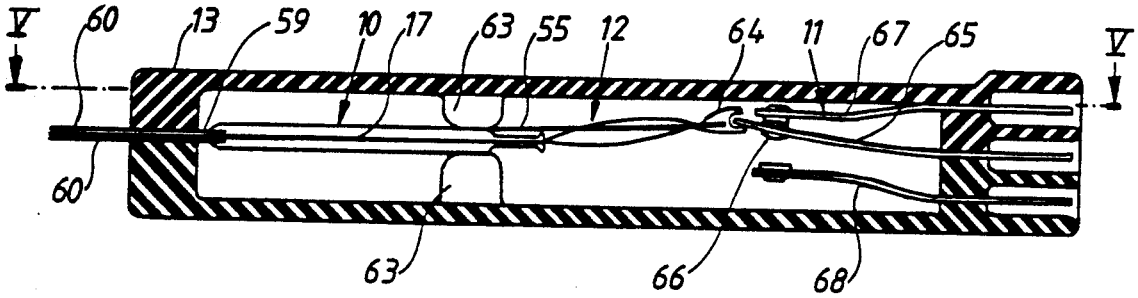
FIG. 4 is a side elevation, partially in longitudinal section of a third embodiment of this invention.

The embodiment shown in FIG. 3 provides a holder 13 which preferably has a boxlike shape. The holder encloses the arm 10, the contact means 11, and the spring 12. The arm 10 and the spring 12 in this embodiment are integrated and include three sheet metal portions. One of these portions consists of an elongated, frame-shaped metal plate 35 with a rectangular opening 36. One end 37 of the metal plate 35 is provided with a contact 38 at each side. From the end 37, three parallel tongues 39*a*, 39*b*, 39*c* extend into the opening in a way which will be described hereinafter. From the end 37, two parallel edge portions 40 extend to the other end 41 of the metal plate 35. The end 41 provides a terminal 42 connectable with an electric circuit (not shown).

The two other sheet metal portions 43 are identical, and comprise a flat end 44 which is pressed against the two sides of the end 41 by the holder 13. The metal plate surfaces of the ends 41 and 44 can be separated from each other by means of an electrically insulating layer (not shown). The flat end 44 continues towards the interior of the holder, providing a narrowed, weakened section 45, and projects outside the holder as a terminal 46. The weakened section 45 continues into an elongated, stiff profile-shaped portion 47 which is U-shaped in cross section. The upper, thin sheet metal plate portion is turned so that the U-shape is inverted, and the two portions are separated by an air gap 17. The profile-shaped portion 47 continues into a flat portion 48 with outer, upwardly and downwardly bent edges 49. The two flat portions 48 are connected to each other, for instance, by spot welding.

Each sheet metal portion 43 has a printed circuit 50 which is placed on the elongated profile-shaped portions 47 and has conductive paths 51 connected with the terminals 46 so that a control current may flow through the printed circuits, thereby heating the upper or lower portions 47.

The upwardly and downwardly bent edges 49 together form an abutting surface for the tongues 39*a*, 39*b*, 39*c*, these tongues having a length and being so fastened that they are arced. The tongues 39*a* and 39*c* have their concave sides turned downwardly, and the tongue 39*b* has its concave side turned upwardly, which means that a snap action is achieved when the flat portion 48 of the metal portion 43 is moved upwards or downwards with respect to the end 37 of the sheet metal plate 35.

The contact means 11 in this case comprises two sheet metal supports 52 and 53 which are fixed into the holder 13, each having a contact 54 with which the contact 38 of the end 37 of the sheet metal plate cooperates. The ends of the sheet metal supports 52 and 53 are shaped as terminals to which electric circuits may be connected in a conventional manner.

This device operates so that current which is directed through the terminal 42 flows through the metal plate 35, and possibly through the sheet metal portions 43, to the contact 38, which in the figure shown abuts the contact of the sheet metal support 53. In order to switch the current over to the sheet metal support 52, a control current is directed through the printed circuit 50 on the upper elongated portion 47, which means that the upper portion 48 is heated and expands, whereas, the corresponding lower portion mainly keeps its shape. Since the portions 47 have a comparatively large bending resistance about an axis which is perpendicular to the length direction of the arm, and which also is perpendicular to the direction of movement of the arm, the expansion difference between the two portions 43 causes a downwardly bending movement of the arm 10. The bending occurs primarily at the weakened section 45, since the sheet metal portions 43 have a comparatively small bending resistance in said direction. The downwardly directed movement of the outer free ends of the portions 43, and hence of the flat portion 48, causes the tongues 39*a*, 39*b*, 39*c* to be compressed. When the force component on the end 37 of the metal support 35 created by the tongues is directed upwardly, the end 37 will snap over to an upper position, where the contact 38 will abut the contact 54 of the sheet metal support 52, which means that current can be taken out from the sheet metal support 52.

In a corresponding way, the sheet metal plate can be returned by directing a control current through the circuit 50 or the lower sheet metal plate portion 43.

It should be observed that according to this embodiment, it is possible to temporarily achieve a switch-on effect of the sheet metal support 52 with an automatic returning function when the control current is switched off. This is done by placing the sheet metal support 52 at a lower level than what is shown, so that the end 37 will automatically snap back to the position against the contact on the support 53 whenever control current is not applied. This means that the lower sheet metal plate portion does not have to be equipped with a printed circuit in such variation.

The embodiment shown in FIGS. 4–8 also includes a holder 13, an arm 10, a spring 12, and a contact means 11. As in the last-mentioned embodiment, the arm 10 and the spring 12 comprise cooperating sheet metal plate portions. One part 55 with tongues 56 strains against the outer end of the two other portions 57, which at this end are secured to each other. The two portions 57 are separated from each other by means of an air gap 17, and have an elongated, stiff portion 58, which in section is U-shaped. This portion near the holder 13 continues into a flat section 59, which has reduced bending resistance. This section continues into the terminal 60, to which a connection means for a control current is attached. At each terminal 60, there is a conductive path 61 to which a printed circuit 62 applied on the elongated stiff portions 58 is connected so that a control current can heat one of the portions 58.

The sheet metal plate part 55, as in the last-discussed embodiment, is U-shaped and is at its middle part at both sides supported by guides 63 projecting from the holder 13. These guides limit the necessary vertical space in the holder for the movement of the arm and the spring.

The outer free end of the arm has a fork 64 surrounding a flexible sheet metal support 65 with a contact 66 on its upper and lower sides. The contacts 66 may cooperate with corresponding contacts on upper and lower sheet metal supports 67 and 68, respectively. All of the sheet metal supports 65, 67, and 68 are mounted on the holder, and extend outside of the holder, where they continue into terminals which can be connected to electric conduits.

The device operates in a manner similar to the previously described embodiments. Current supplied through the sheet metal support 65 can flow through either the sheet metal support 66 or the sheet metal support 67, by directing a control current to the upper or the lower printed circuit 62 from the terminals 60. The heat expansion difference which will follow is converted into a bending moment of the arm 10. The bending takes place primarily at the weakened section 59. The bending means that the snap action of the spring 12 is activated and, at the fork 64, moves the sheet metal support 65 from an upper to a lower position, or vice versa.

Figure 5:
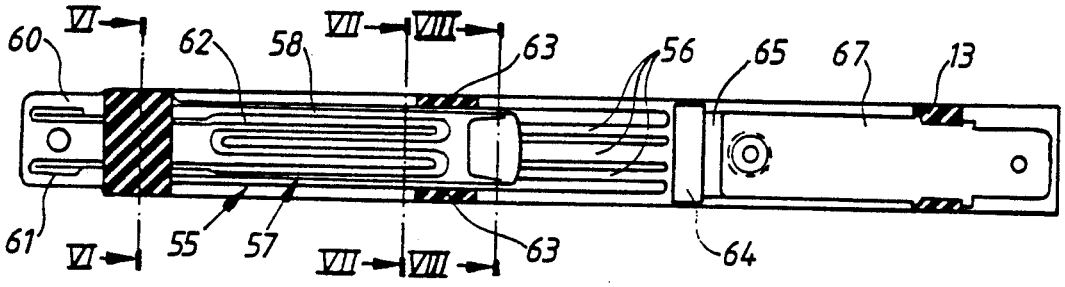
FIG. 5 is a plan view, partially in longitudinal section, illustrating the embodiment of FIG. 4.
Figure 6:
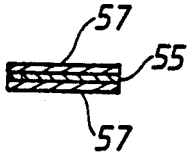
FIGS. 6 through 8 are respectively fragmentary sections taken along line VI—VI, VII—VII, and VIII—VIII of FIG. 5.
Figure 7:
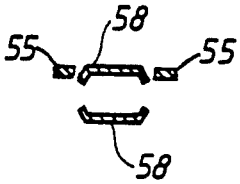
Figure 8:
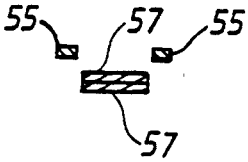

It should be observed that several devices, for instance, of the type which is shown in FIG. 5 preferably are placed beside each other for creating a complete chain of relay functions.

Although the preferred embodiments of this invention have been shown and described, it should be understood that various modifications and rearrangements of the parts may be resorted to without departing from the scope of the invention as disclosed and claimed herein.

What is claimed is:

1. A switch which is controlled by electricity having a first fixed end and a second end movable perpendicular to the length direction of the arm, comprising two substantially parallel portions (15, 16, 47, 57) which are thermally separated from each other and are connected to each other at their ends, electrical heating means associated with at least one of said portions causing longitudinal differential expansion of said one portion with respect to the other of said portions to achieve said movement, said portions being shaped adjacent the end which is fixed (at 18, 45, 39) to provide a reduced bending resistance compared with the remainder of said portions about an axis which is perpendicular to the length direction of said arm and to said direction of movement, said portions (43, 58) having a profile along the major part of the distance between said ends shaped to increase the bending resistance thereof, and said portions being flat and abutting each other in the area of reduced bending resistance.

2. A switch as set forth in claim 1, wherein said profile is a U-shaped profile.

3. A switch including an arm as set forth in any of the preceding claims, wherein said switch includes contact means, and a spring connecting said arm and contact means operating said contact means in response to said movement, said spring (12) being a compression-type spring which is inserted between said arm (10) and said contact means (11), movement of said arm causing snap action of said contact means so that said contact means move stepwise between two positions in response to said bending movement of said arm.

4. A switch as set forth in claim 3, wherein said spring (12) comprises at least two arched tongues the concave sides of which are facing each other and the ends of which are compressed between said contact means (11) and said arm (10).

5. A switch as set forth in claim 4 having an elongated frame, one end of said frame extending between said one end of said portions, the other end of said frame supporting a movable contact of said contact means, said frame also providing tongues (**39*a*, 39*b*, 39*c***) compressed against the other ends of said portions to provide said spring.

6. A switch as set forth in claim 2, in which at least one of said portions (15, 16, 47, 57) supports an electrical circuit (23, 24, 50, 62) through which a control current can flow to heat the associated portion.

* * * * *